US005577452A

United States Patent [19]

Yindra

[11] Patent Number: 5,577,452

[45] Date of Patent: Nov. 26, 1996

[54] TABLE LOCKING APPARATUS

[75] Inventor: Leonard J. Yindra, Manitowoc, Wis.

[73] Assignee: Palmer/Snyder Furniture Co., Conneautiville, Pa.

[21] Appl. No.: 393,412

[22] Filed: Feb. 23, 1995

[51] Int. Cl.[6] ..... A47B 3/08; A47B 5/04; A47B 5/06

[52] U.S. Cl. ..... 108/168; 108/35; 108/42; 292/36; 292/42

[58] Field of Search ..... 108/168, 134, 108/40, 39, 35, 42; 292/36, 42

[56] References Cited

U.S. PATENT DOCUMENTS

| | | | |
|---|---|---|---|
| 1,059,999 | 4/1913 | James et al. | 292/36 |
| 1,319,011 | 10/1919 | Kuretich | 292/36 |
| 2,131,675 | 9/1938 | Schieber | 108/40 |
| 2,392,874 | 1/1946 | Pelaez | 292/36 |
| 2,699,978 | 1/1955 | Mugler | 108/39 |
| 2,739,860 | 3/1956 | Wilson | 108/39 |
| 3,622,187 | 11/1971 | Emery | 292/36 |

*Primary Examiner*—Peter M. Cuomo
*Assistant Examiner*—Anthony D. Barfield
*Attorney, Agent, or Firm*—Jansson & Shupe, Ltd.

[57] ABSTRACT

The new table locking apparatus has opposed bolts, each connected to a rigid link for axial bolt movement. In the improvement, each link is pinned to an operating rod and the operating rod is coupled to a hand-operated toggle mechanism for bolt movement. The toggle mechanism provides positive control of bolt position. The apparatus is particularly useful with tables of the type stored in wall pockets and used in schools and other institutions.

10 Claims, 5 Drawing Sheets

FIG. 6
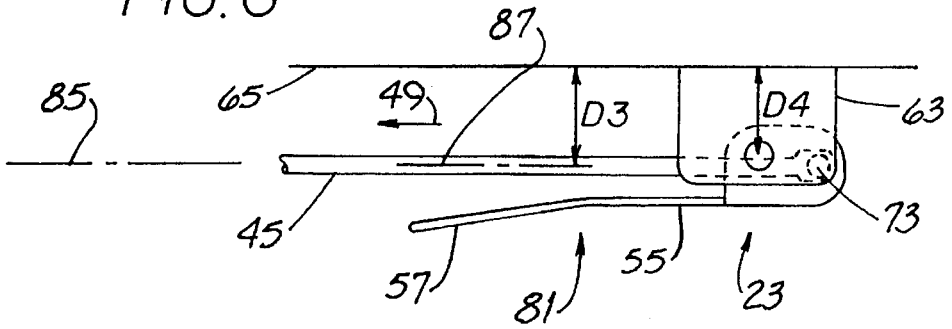
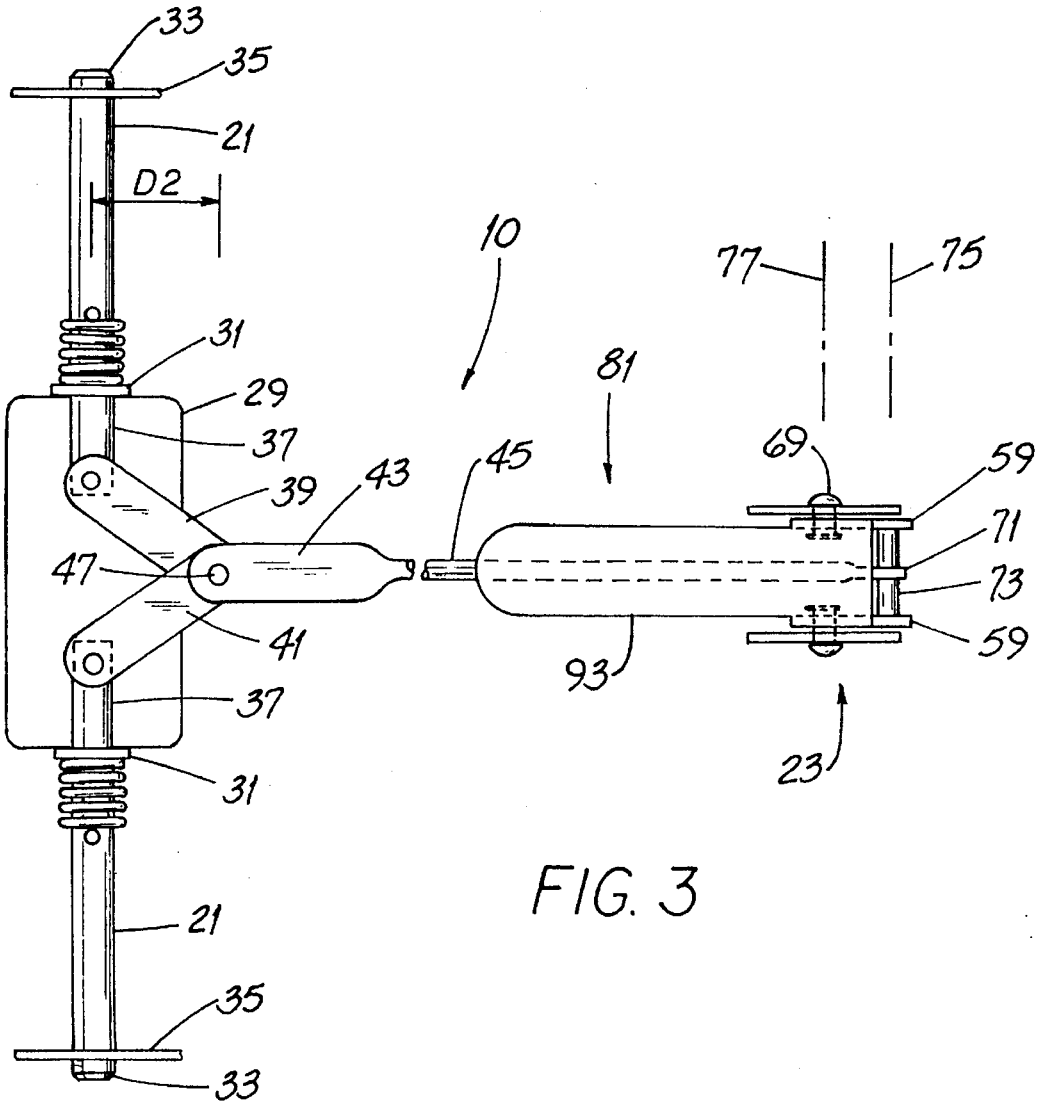
FIG. 3

FIG. 7
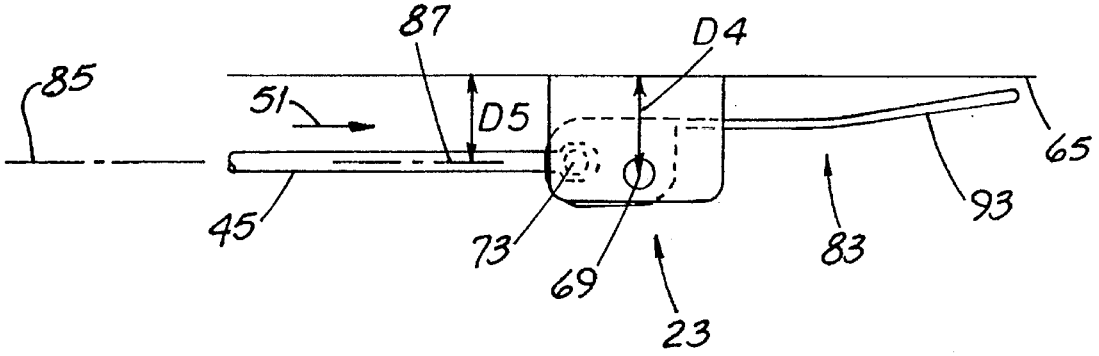
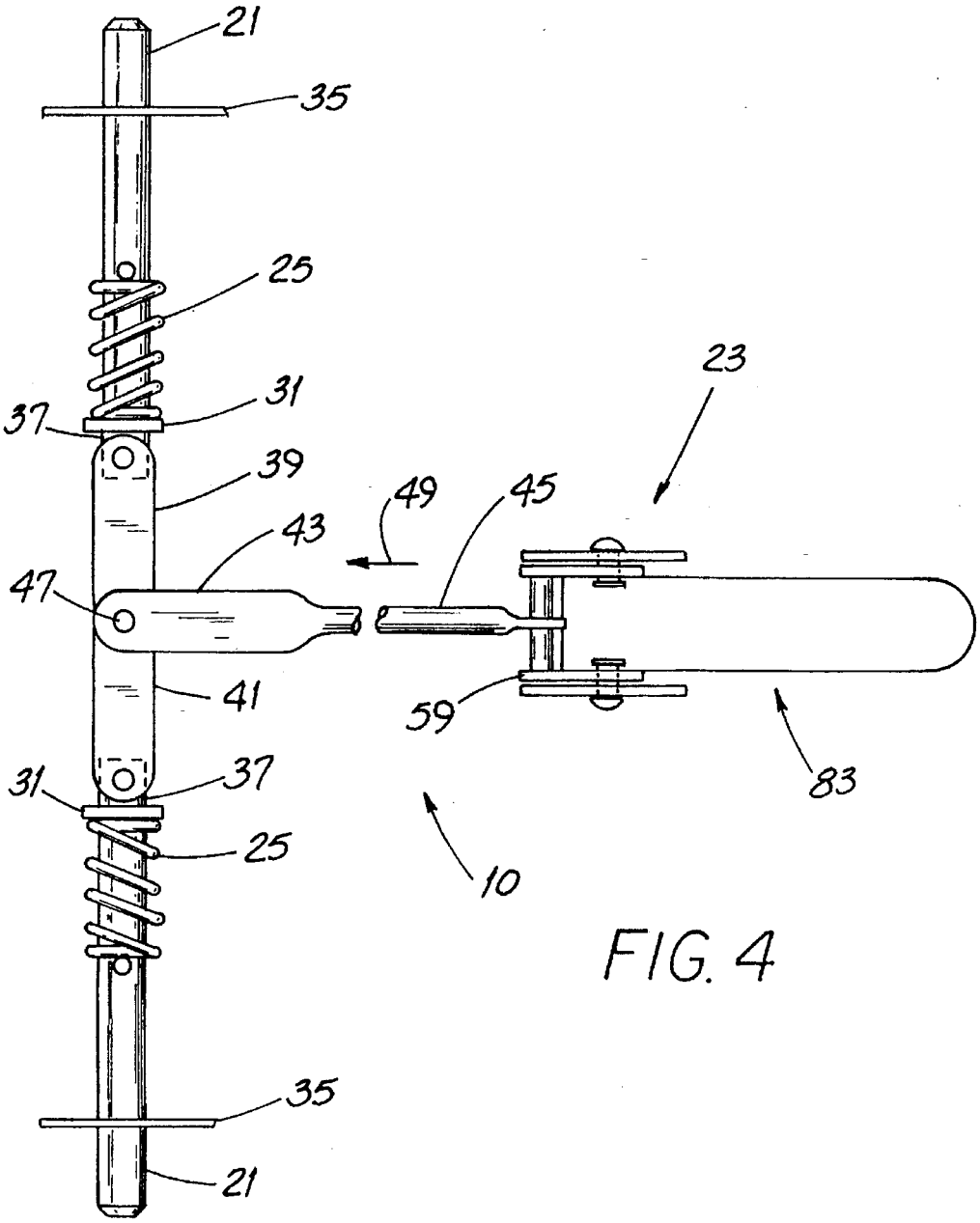
FIG. 4

TABLE LOCKING APPARATUS

FIELD OF THE INVENTION

This invention relates to horizontally supported surfaces, e.g., tables, and, more specifically, to locking mechanisms for tables.

BACKGROUND OF THE INVENTION

Schools and other institutions often have "multi-use" rooms, some uses of which require tables. On the other hand, there are times when tables are not needed; rather, open floor space is needed. To that end, many manufacturers of institutional furniture provide tables which fold in the middle and are stored in recessed wall pockets. And such tables employ "opposed bolt" locking bars of one type or another. Such bars provide a "pivot axis" about which the table pivots when being unfolded out of the pocket to a horizontal position or when being re-folded from the horizontal position to be stored in the pocket.

Specifically, such locking bolts are axially retractable to "clear" the side panels of the wall pocket when withdrawing the end of unfolded table from such pocket. And such bolts are extended into slots in the pocket side panels when one is preparing to re-fold the table into the pocket.

In the past, different types of mechanical arrangements have been used to extend and retract table locking bolts. One type involves a rotating handle arrangement which is located at the "pocket end" of the table and coincident with the long axis of the bolts. The handle is rotated in one direction to urge the bolts outward and in the other to retract them. Such handles are difficult to reach and to operate. And if the table is the first to be stored in a deep wall pocket, the handle is well within the pocket. One must virtually crawl into the pocket to operate such handle.

In another type, the bolts are extended and retracted using a flexible wire oriented perpendicular to the long axis of the bolts and positioned midway between such bolts. The wire is attached to the center of a flexible chain-like yoke, each end of which is coupled to the end of a separate bolt. Pulling on the wire retracts the bolts and releasing it permits the bolts to extend under spring urging. Each of the foregoing arrangements has been attended by certain problems.

For example (and with respect to the rearward or rearmost table in a wall pocket), the rotating handle in the first-described arrangement is very difficult to reach and operate, especially if a particular wall pocket stores three or four tables. For the inward-most tables, the handle is rather deep in the pocket. In the type using the flexible wire, the wire breaks rather easily and adjustment of lock bolt stroke is difficult.

Other prior art arrangements are depicted in U.S. Pat. Nos. 1,197,612 (Ditlevson); 1,174,652 (Banks); 1,273,332 (Cline) and 1,900,785 (Ashbrook). The Ditlevson patent depicts a garage door lock having a pair of retractable bolts, each of which is connected to one end of a separate toggle arm. These toggle arms are moved by forces applied thereto by two end-to-end rods. One of the two rods is supported and guided by a bracket.

The end-to-end rods are operated by a rather complex lever arrangement having several pivot points and including as a component a bellcrank-shaped lever which the patent refers to as a "bent arm lever."

The Banks patent shows a twin door latch having a pair of axially opposed, spring biased bolts operated by applying force to a pair of pivotably-pinned bell crank levers. Between each bolt and its corresponding bell crank lever, there is a connecting bar having a U-shaped yoke at either end.

The latch is operated by pushing on an operating pin which rotates the bell crank levers and retracts the bolts. When the pin is released, the bias springs return the bolts to their locking positions.

The Cline patent depicts a locking fastener arrangement for the hood of an automobile of the type having two side-lifted engine compartment covers. The fastener has a pair of relatively short axially opposed bolts, each of which is pinned to a separate link. In turn, the links are commonly pinned to a bolt-like handle which moves in a slot. Upward force applied to the handle retracts the bolts for hood opening. The fastener is re-latched manually or, perhaps, by gravity.

The Ashbrook patent (involving a rather unusual arrangement for an automatic door opener) depicts a single locking bar which is spring biased open but held in the "door locked" position by a curved operating lever pinned at its center. One end of the lever had an aperture through it to receive the arm portion of an L-shaped lever, the other end of which protrudes through the door to the exterior.

In use, a vehicle driver runs the vehicle against the outer end of the L-shaped lever to release the operating lever. Such lever is then pivoted (through a linkage) by the springs to an unlatched position. Presumably, the mechanism is reset manually after each use.

OBJECTS OF THE INVENTION

It is an object of this invention to provide an improved table locking mechanism overcoming some of the problems and shortcomings of the prior art.

Another object of the invention is to provide an improved locking mechanism which is suitable for use with pocket-stored tables.

Another object of the invention is to provide an improved table locking mechanism which is easy to use, even with multiple tables stored in a pocket.

Yet another object of the invention is to provide an improved table locking mechanism having a handle mechanism which is easy to reach.

Still another object of the invention is to provide an improved table locking mechanism which provides positive bolt-positioning under direct control of the user.

How these and other important objects are accomplished will be apparent from the following descriptions and from the drawing.

SUMMARY OF THE INVENTION

The invention involves improvements in a locking apparatus of the type having opposed bolts, each connected to a separate rigid link for axial bolt movement. In the improvement, each link is pivotally pinned to a rigid elongate operating rod and the operating rod is coupled to a hand-manipulated toggle mechanism for bolt movement. When the apparatus is used in connection with a pocket-stored table, the toggle mechanism is at an easy-to-use location spaced from the wall pocket.

In another aspect of the invention, the bolts are mounted for movement between a lock position and an unlock position. One end of-the operating rod is coupled to the toggle mechanism by a rod operating pin and the other end of such rod is coupled to the links by a link pin. When the toggle mechanism is operated, the operating pin and the link pin both move. And when the bolts move between the lock position and the unlock position, the distances moved by each pin are substantially equal to one another.

In yet another aspect of the invention, the toggle mechanism includes a fulcrum pin about which the mechanism handle pivots. The rod operating pin includes a central longitudinal axis and the locus of the axis is parallel to and at a substantially constant distance from the fulcrum pin when the handle is pivoted and the bolts moved between the lock position and the unlock position.

A feature of the new apparatus is that the user always has positive control of handle position and, therefore, of bolt position. That is, the bolts are coupled by pivot pins and rigid components to the handle. For every bolt position, there is a corresponding handle position and vice versa.

In a table equipped with the new apparatus, the handle is moved between a first or "bolts-unlocked" position and a second or "bolts-locked" position. When at either position, the handle is substantially parallel to the table top surface. Similarly, the central longitudinal axes of the fulcrum pin and the rod operating pin are also substantially parallel to the table top surface. However, such relationship does not change with handle movement.

In yet another aspect of the invention, the handle has a pair of spaced side plates which are substantially parallel to one another and generally perpendicular to the main handle portion. The handle is pivotably mounted on a support bracket which has a handle support portion. The handle side plates and the support portion are also generally parallel to one another and are generally perpendicular to the table top surface.

Other aspects of the invention relate to details of the toggle mechanism. Such mechanism is supported by the table underside surface and has a fulcrum pin about which the handle pivots. The operating rod extends along a force axis and when the handle is in the first or bolts-unlocked position, such force axis is spaced from the table underside surface by a dimension no less than (and, preferably, somewhat greater than) that distance by which the fulcrum pin is spaced from the same surface. On the other hand, when the handle is in the second or bolts-locked position, the force axis is spaced from the surface by a dimension somewhat less than that by which the fulcrum pin is spaced from the table underside surface.

In the highly preferred embodiment, the toggle mechanism includes a first class lever, i.e., a lever which pivots about an axis located between the "force-application" point and the "force-output" point. Of course, after appreciating this specification, persons of ordinary skill in the art will understand how to use other types of levers, e.g., second or third class levers.

Further details regarding the invention are set forth in the following detailed description and in the drawing.

BRIEF DESCRIPTION OF THE DRAWING

FIG. 3 is a bottom plan view of the inventive table locking mechanism taken generally along the viewing axis VA3 of FIG. 2 and showing the mechanism in the "bolts-unlocked" position. Parts are broken away and certain surfaces are shown in dashed outline.

FIG. 4 is a bottom plan view of the inventive table locking mechanism taken generally along the viewing axis VA3 of FIG. 2 and showing the mechanism in the "bolts-locked" position. Parts are broken away and certain surfaces are shown in dashed outline.

FIG. 6 is a side elevation view of the toggle mechanism shown in a "bolts-unlocked" position. Parts are broken away and certain surfaces are shown in dashed outline.

FIG. 7 is a side elevation view of the toggle mechanism shown in a "bolts-locked" position. Parts are broken away and certain surfaces are shown in dashed outline.

DETAILED DESCRIPTIONS OF PREFERRED EMBODIMENTS

Before describing details of the new table locking apparatus 10, it will be helpful to have a better understanding of a way in which such apparatus 10 is used. When considering the following specification, it should be appreciated that irrespective of whether the table 11 has just been unfolded from a pocket 15 for use or whether the user is preparing to re-store the table 11 in the pocket 15 after use, the apparatus 10 is operated only when the table 11 is horizontal and resting on the floor.

Figure 1:
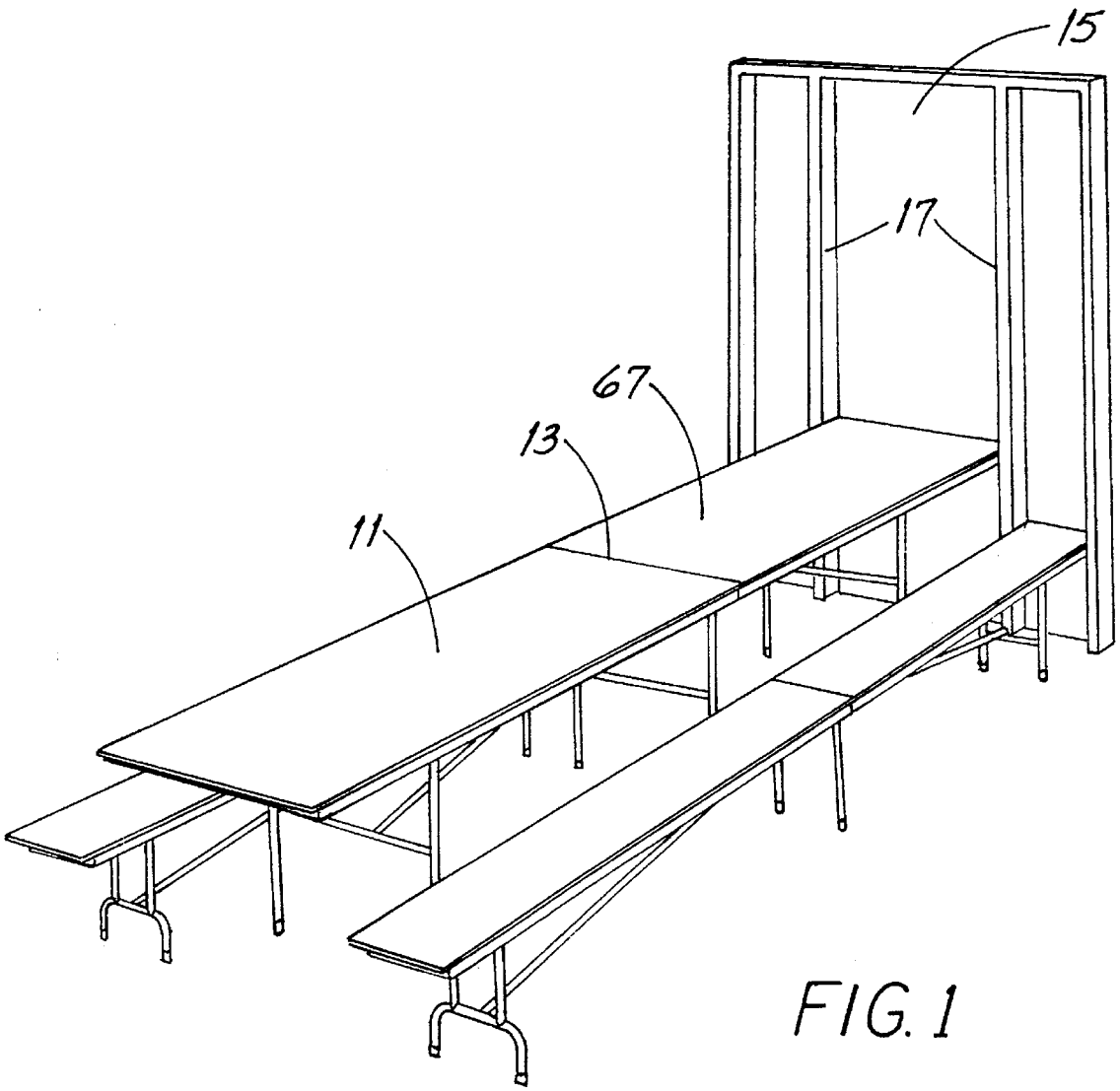
FIG. 1 is an isometric view of a folding table of the type stored in a wall pocket.
Figure 2:
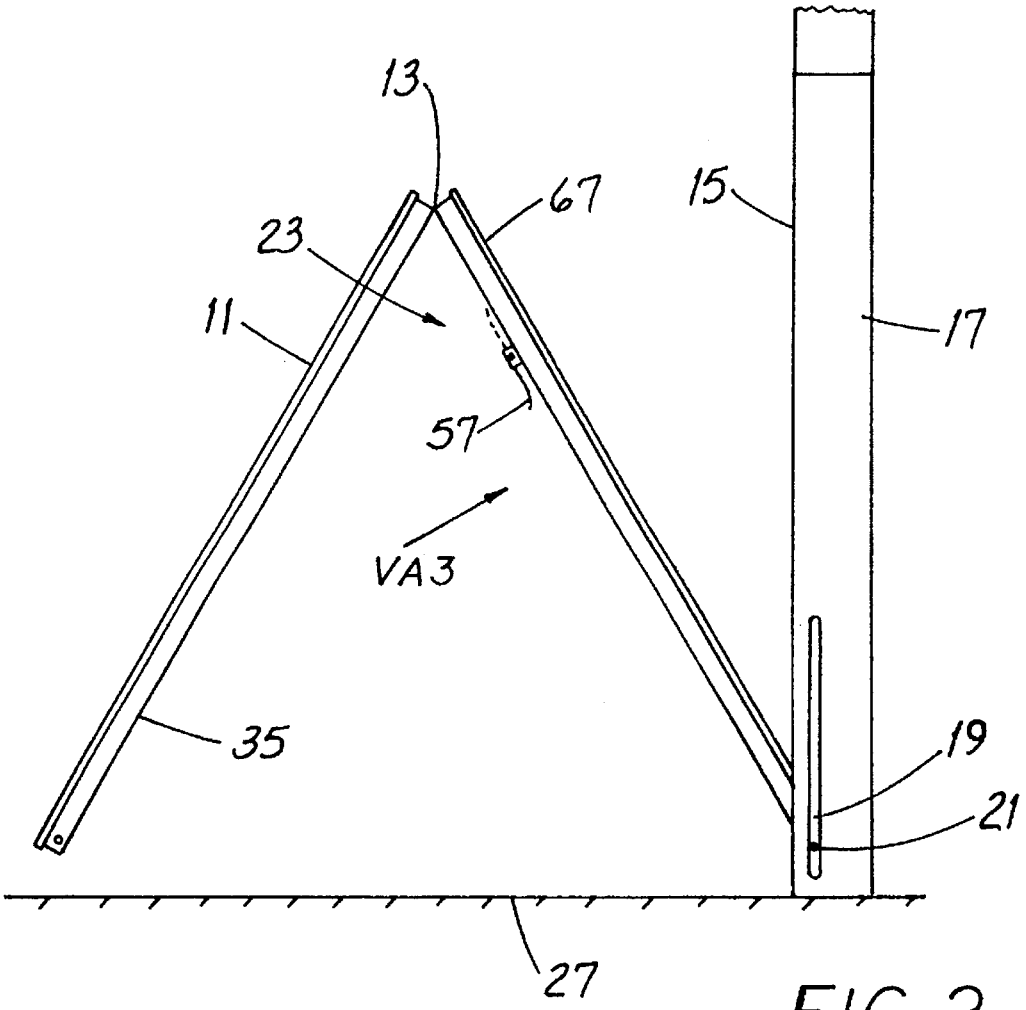
FIG. 2 is a side elevation view of the table of FIG. 1 shown in a partially-folded position.

Referring to FIGS. 1 and 2, the locking apparatus is shown in conjunction with the table 11 of the type having a hinge joint 13 midway between the table ends. When the table 11 (and associated benches) are set up for use, they appear as in FIG. 1. When the occupied floor space is to be used for other purposes (or if the user 10 simply wishes to store the table 11 out of the way), the table 11 is folded into and stored in a wall pocket 15.

Such pocket 15 is defined in part by a pair of spaced vertical stanchions 17, each of which includes an opening 19 for receiving a table locking bolt 21 when the table 11 is stored or when it is being folded or unfolded. And it is to be appreciated that the pocket 15 may be sufficiently deep to store three or four tables 11 when folded. There is a pair of openings 19 (one on each spaced stanchion 17) for each table 11 to be stored.

It is assumed that the table 11 has been withdrawn from the pocket 15 and has been in use elsewhere in the room. Referring now to FIG. 3, when the user desires to store a table 11, that end of the table 11 equipped with locking bolts 21 (and with bolts 21 retracted) is urged into a pocket 15. When the bolts 21 are retracted, the ends of such bolts 21 "clear" the respective stanchions 17 so that the end of the table 11 can be readily inserted into the pocket 15.

For storage, the table 11 is urged into the pocket 15 to a position such that each bolt 21 is in registry with its respective opening 19. Using the toggle mechanism 23, the bolts 21 are then extended to a locked position as shown in FIG. 4. In such position, the bolts 21 extend through the respective bolt openings 19, and compression springs 25 urge the bolts 21 in the extended or locked direction. The table 11 is thus ready to be folded upward from its horizontal "in use" position (as shown in FIG. 1) to the stored position. When being folded for storage as shown in FIG. 2, the inward end of the table 11 pivots about the now-engaged bolts 21.

A feature of the new apparatus 10 is that it is very easy to use. If the table 11 being stored is the first of several to be placed in the pocket 15, it will be appreciated that the end of the table 11 on which the bolts 21 are mounted will be quite deep in the pocket 15. Notwithstanding, the toggle mechanism 23 will be well away from the pocket 15 and very easy to operate by simply reaching under the table 11 at about chest height, notwithstanding that the openings 19 are near the floor 27.

Further details of the new apparatus 10 will now be described. Such apparatus 10 has a pair of elongate, generally cylindrical bolts 21 supported by and mounted for opposed movement in a plate-like bolt guide device 29 having a pair of upstanding "eye" portions 31 through which the bolts 21 protrude. Such bolts 21 are coaxial and move coaxially in opposite directions.

In their unlocked positions (shown in FIG. 3), the outer ends 33 of the bolts 21 are nearly flush with the respective side edges 35 of the table 11. When the table 11 is in the pocket 15 and the bolts 21 are in the locked position (shown in FIG. 4), such bolts 21 extend well past such side edges 35. In fact, the bolts 21 extend sufficiently far to protrude through their respective openings 19 in the stanchions 17 as described above.

The inward or proximal end 37 of each bolt 21 is pivotably pinned to one end of a rigid, bar-like link 39, 41. The other ends of the links 39, 41 are pivotably attached to one another and to the first or distal end 43 of a rigid, tube-like operating rod 45. Link/rod attachment is by a link pin 47. From an inspection of FIGS. 3 and 4, it will now be apparent that movement of the rod 45 in the direction of the arrow 49 will urge the bolts 21 to a locked position. Similarly, movement of the rod 45 in the direction of the arrow 51 will urge the bolts 21 to an unlocked position.

Figure 5:
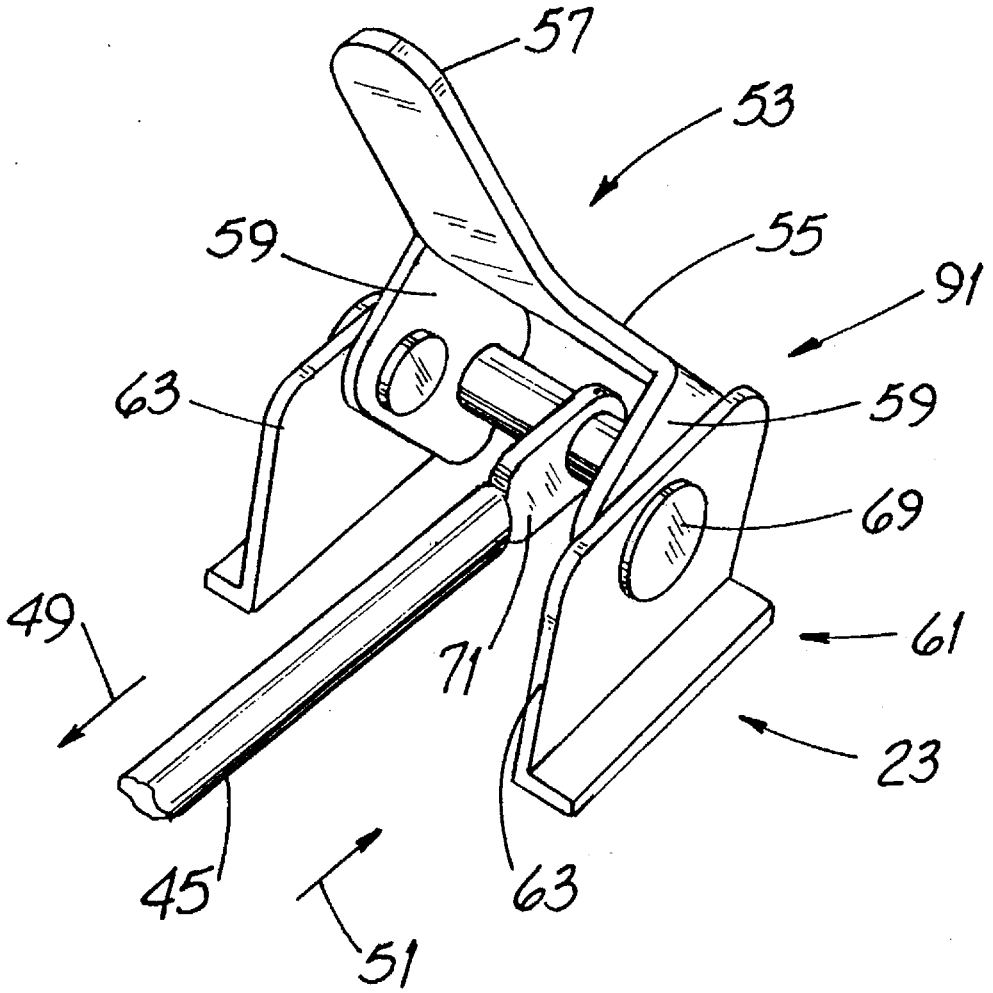
FIG. 5 is an isometric view of the toggle mechanism portion of the new locking mechanism. Parts are broken away.

Referring particularly to FIGS. 5, 6 and 7, the operating rod 45 is coupled to a hand-manipulated toggle mechanism 23 for bolt movement and details of such mechanism 23 will now be set forth. The toggle mechanism 23 includes a generally flat handle 53 having a main portion 55 and a gripping portion 57 extending slightly angularly from the main portion 55.

Such handle 53 also has a pair of spaced side plates 59 which are substantially parallel to one another and generally perpendicular to the main portion 55. The handle 53 is pivotably mounted on a support bracket 61 having a pair of handle support portions 63 extending away from the underside of the table 11. The handle side plates 59 and the support portions 63 are generally parallel to one another and generally perpendicular to the table top surface 67 and the table underside 65. Pivoting mounting of the handle side plates 59 to the support portions 63 is by a fulcrum pin 69 embodied as a pair of studs.

Figure 8:
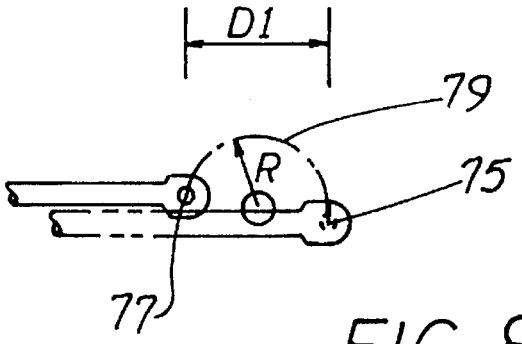
FIG. 8 is a side elevation view of portions of the toggle mechanism showing in solid outline the operating rod in the "bolts-locked" position and showing such rod in the "bolts-unlocked" position in dashed outline. Parts are broken away.

Referring also to FIG. 8, the new apparatus 10 is characterized by certain geometric relationships. For example, the second or proximal end 71 of the operating rod 45 is pivotably pinned to the handle side plates 59 by a rod operating pin 73. When the toggle mechanism 23 is operated, the operating pin 73 and the link pin 47 both move. And when the bolts 21 move between the lock position and the unlock position, the distance "D1" moved by the rod operating pin 73 is substantially equal to the distance "D2" moved by the link pin 47.

As another example, the rod operating pin 73 and the fulcrum pin 69 each include a central longitudinal axis, i.e., axes 75 and 77, respectively. As represented by the arc 79, the locus of the axis 75 is parallel to and at a substantially constant distance "R" from the axis 77 of the fulcrum pin 69 when the handle 53 is pivoted to move the bolts 21 between the locked position shown in FIG. 4 and the unlocked position shown in FIG. 3.

As mentioned above, the handle 53 is moved between a first or "bolts-unlocked" position 81, shown in solid outline in FIGS. 3 and 6, and a second or "bolts-locked" position 83 shown in FIGS. 4 and 7. When at either position, the handle 53 is substantially parallel to the table top surface 67. Similarly, the central longitudinal axes 77, 75 of the fulcrum pin 69 and the rod operating pin 73 are also substantially parallel to the table top surface 67. However, unlike the angular relationship of the handle 53 to the table top surface 67 during handle movement, the angular relationships of the fulcrum pin 69 and operating pin 73 to such top surface 67 do not change with handle movement.

And the new apparatus 10 has yet other geometric relationships. For example, when the handle 53 is in the bolts-unlocked position 81 as shown in FIGS. 3 and 6, the fulcrum pin 69 is between the operating pin 73 and the link pin 47. And when the handle 53 is in the bolts-locked position 83 as shown in FIGS. 4 and 7, the operating pin 73 is between the fulcrum pin 69 and the link pin 47. Further, the bolts 21, the links 39, 41, the link pin 47 and the fulcrum pin 69 are all substantially coincident with a plane 85, irrespective of whether the handle 53 is in the bolts-locked position 83 or the bolts-unlocked position 81.

Referring also to FIGS. 6 and 7, other aspects of the invention relate to details of the toggle mechanism 23. Such mechanism 23 is supported by the table underside surface 65 and when the handle 53 is in the first or bolts-unlocked position 81 shown in FIG. 6, the operating rod 45 extends along a first force axis 87. Such force axis 87 is spaced from the table underside surface 65 by a dimension "D3" which is slightly greater than that dimension "D4" by which the fulcrum pin 69 is spaced from the same surface 65.

On the other hand, when the handle 53 is in the second or bolts-locked position 83 as shown in FIG. 7, the force axis 87 is spaced from the surface 65 by a dimension "D5." Such distance "D5" is no greater than (and, preferably, somewhat less than) that distance "D4" by which the fulcrum pin 69 is spaced from the table underside surface 65.

Considered yet another way, in the highly preferred embodiment, the toggle mechanism 23 includes a first class lever 91, i.e., a lever which pivots about an axis located between the "force-application" point 93 on the handle 53 and the "force-output" point at pin 73. Of course, after appreciating this specification, persons of ordinary skill in the art will understand how to use other types of levers, e.g., second or third class levers, in configuring the apparatus 10. (First, second and third class levers per se are well known in the field of engineering mechanics.)

A feature of the new apparatus 10 is that the user always has positive control of handle position and, therefore, of bolt position. That is, the bolts 21 are moved by manipulating the toggle mechanism handle 53 and the bolts 21 are always at a position which corresponds to a particular position of the handle 53. In other words, the bolts 21 (as well as the links 39, 41 and operating rod 45) "follow" the position of the handle 53.

While the principles of the invention have been shown and described in connection with particular embodiments, it is to be understood clearly that such embodiments are by way of example and are not limiting.

What is claimed:

1. In a locking apparatus having opposed bolts, each connected to a rigid link for axial bolt movement, the improvement wherein:

each link is pivotally pinned to an operating rod; and the operating rod is coupled to a toggle mechanism for bolt movement;

the bolts are mounted for movement between a lock position and an unlock position;

the toggle mechanism includes a fulcrum pin and a rod operating pin, such operating pin extending along a central longitudinal axis;

the links are pinned to the rod by a link pin;

and wherein:

when the bolts move between the lock position and the unlock position, the distances through which the operating pin and the link pin move are substantially equal to one another; and the axis is at a substantially constant distance from the fulcrum pin.

2. The apparatus of claim 1 in combination with a table having a top surface and wherein:

the fulcrum pin extends along a central longitudinal axis; and the fulcrum pin axis is generally parallel to the table top surface.

3. The apparatus of claim 2 wherein the rod operating pin axis is generally parallel to the table top surface.

4. The apparatus of claim 1 wherein:

the toggle mechanism is supported by a surface;

the toggle mechanism is mounted for movement between a first "bolts-unlocked" position and a second "bolts-locked" position;

when the toggle mechanism is in its first position, the fulcrum pin is spaced from the surface by a first dimension; and when the toggle mechanism is in its second position, the operating rod is spaced from the surface by a second dimension which is less than the first dimension.

5. In a table having top and underside surfaces and a locking apparatus used during table storage and having opposed bolts, each connected to a separate link for axial bolt movement, the improvement comprising:

a toggle mechanism for positioning the bolts and having a handle mounted for movement between a first "bolts-unlocked" position and a second "bolts-locked" position;

an operating rod extending between the links and the mechanism;

the handle has a pair of spaced side plates substantially parallel to one another; and the handle is pivotably mounted on a support bracket, whereby the bolts move between a locked position and an unlocked position when the handle is moved between the first position and the second position.

6. The table of claim 5 wherein:

the handle is substantially parallel to the table top surface when the handle is in the first position or the second position.

7. The table of claim 6 wherein:

the handle pivots about a fulcrum pin;

the operating rod and the handle are coupled together by an operating rod pin; and the operating rod pin and the fulcrum pin are substantially parallel to the table top surface.

8. The table of claim 5 wherein:

the support bracket has a handle support portion; and the handle side plates and the support portion are generally parallel to one another.

9. The table of claim 8 wherein the handle side plates and the support portion are generally perpendicular to the table top surface.

10. The table of claim 5 wherein:

the toggle mechanism is supported by the table underside surface and includes a fulcrum pin;

when the handle is in the first position, the fulcrum pin is spaced from the underside surface by a first dimension, and the operating rod is spaced from the surface by a second dimension which is greater than the first dimension;

and wherein:

when the handle is in the second position, the operating rod is spaced from the surface by a third dimension which is less than the first dimension.

* * * * *